US005553705A

United States Patent [19]

Bakx

[11] Patent Number: 5,553,705

[45] Date of Patent: Sep. 10, 1996

[54] CLIP-TYPE CARRIER FOR FLANGED ARTICLE

[75] Inventor: Martinus C. M. Bakx, Goes., Netherlands

[73] Assignee: The Mead Corporation, Dayton, Ohio

[21] Appl. No.: 361,346

[22] Filed: Dec. 21, 1994

[51] Int. Cl.[6] ..... B65D 75/00

[52] U.S. Cl. ..... 206/158; 206/199; 294/87.2

[58] Field of Search ..... 206/199, 158, 206/156, 151, 145, 155, 153, 161, 427; 294/87.2

[56] References Cited

U.S. PATENT DOCUMENTS

| | | | |
|---|---|---|---|
| Re. 25,781 | 5/1965 | Akeireb | 206/158 X |
| 2,834,461 | 5/1958 | Dusseault . | |
| 3,038,600 | 6/1962 | Powell . | |
| 3,200,944 | 8/1965 | Rapata . | |
| 3,601,253 | 8/1971 | Poupitch . | |
| 3,601,439 | 8/1971 | Poupitch . | |
| 4,432,579 | 2/1984 | Denmark et al. | 294/87.2 |
| 4,621,734 | 11/1986 | Heijnen et al. | 206/427 |
| 5,125,506 | 6/1992 | Galbierz et al. . | |
| 5,263,299 | 11/1993 | Galbierz et al. . | |
| 5,320,216 | 6/1994 | Pangborn . | |

FOREIGN PATENT DOCUMENTS

| | | | |
|---|---|---|---|
| 1395723 | 5/1975 | United Kingdom | 206/158 |
| 2107677B | 1/1985 | United Kingdom . | |
| 2271097 | 4/1994 | United Kingdom . | |
| WO93/21083 | 10/1993 | WIPO . | |

*Primary Examiner*—Bryon P. Gehman
*Attorney, Agent, or Firm*—Michael V. Drew

[57] ABSTRACT

A clip-type carrier (10) has a top wall which includes an inner (20) and an outer (40) panel that overlap at respective lap portions (22, 42). The inner panel (20) has an inner article-receiving aperture (24) for each flanged article (1) to be received. The inner article-receiving aperture (24) has radial cuts (26) that form gripping tabs (28) whose unattached inner edges define an inner aperture circumference and associated inner aperture diameter ($D_{11}$). Each gripping tab (28) terminates at the inner panel to form a second circumference ($C_{12}$) and associated second diameter ($D_{12}$). The second circumference ($C_{12}$) and diameter ($D_{12}$) are greater than the inner circumference and diameter ($D_{11}$). The lap portion (42) of the outer panel (40) has an outer article-receiving aperture (44) corresponding to and in concentric alignment with each inner article-receiving aperture (24). The outer article-receiving aperture (44) has a circumference and associated diameter ($D_0$) that are greater than those of the inner aperture and less than the respective second circumference ($C_{12}$) and diameter ($D_{12}$). The carrier (10) may have securement such as adhesive (34), punch-type locks (36, 38) or locking tabs (49) in the outer panel (40) for securing the inner (22) and outer (42) lap portions to one another.

7 Claims, 6 Drawing Sheets

CLIP-TYPE CARRIER FOR FLANGED ARTICLE

BACKGROUND OF THE INVENTION

The invention relates generally to article carriers for flanged articles, and more particularly to clip-type article carriers which engage flanged articles under their respective flanges.

BACKGROUND ART

It is often desirable to use a so-called clip-type article carrier to transport flanged articles. The clip-type carrier is generally formed from at least one sheet of a flexible material such as paperboard or plastic which engages the underside of the flange of the article. For example, in a can the chime of the can is the flange to be engaged. A bottle may have a cap or annular bead which is the flange to be engaged by the clip. A problem in using clip-type carriers, and in particular paperboard clip-type carriers, is that it is often difficult to insure that the carrier will effectively engage and remain engaged under the underside of a flange. Use of a paperboard article carrier is often desired because paperboard is inexpensive, readily available, accepts printing easily and can be environmentally friendly. What is needed is a clip-type article carrier, particularly one which can be made of paperboard, which more reliably engages flanged articles.

SUMMARY OF THE INVENTION

In a preferred embodiment of the invention a clip-type carrier has a top wall which includes an inner and an outer panel that overlap at respective lap portions. The inner panel has an inner article-receiving aperture for each flanged article to be received. The inner article-receiving aperture has radial cuts that form gripping tabs whose unattached inner edges define an inner aperture circumference and associated inner aperture diameter. Each gripping tab terminates at the inner panel to form a second circumference and associated second diameter. The second circumference and diameter are greater than the inner aperture circumference and diameter. The lap portion of the outer panel has an outer article-receiving aperture corresponding to and in concentric alignment with each inner article-receiving aperture. The outer article-receiving aperture has a circumference and associated diameter that are greater than those of the inner aperture and less than the respective second circumference and diameter. The carrier may have securement means such as adhesive, punch-type locks or locking tabs in the outer panel for securing the inner and outer panels to one another.

In the clip-type carrier of the present invention the outer article-receiving aperture constricts the gripping tabs so that the carrier effectively and reliably engages the flanges of the article for transport.

Other advantages and objects of the present invention will be apparent from the following description, the accompanying drawings, and the appended claims.

DETAILED DESCRIPTION OF THE PREFERRED EMBODIMENT

Figure 1:
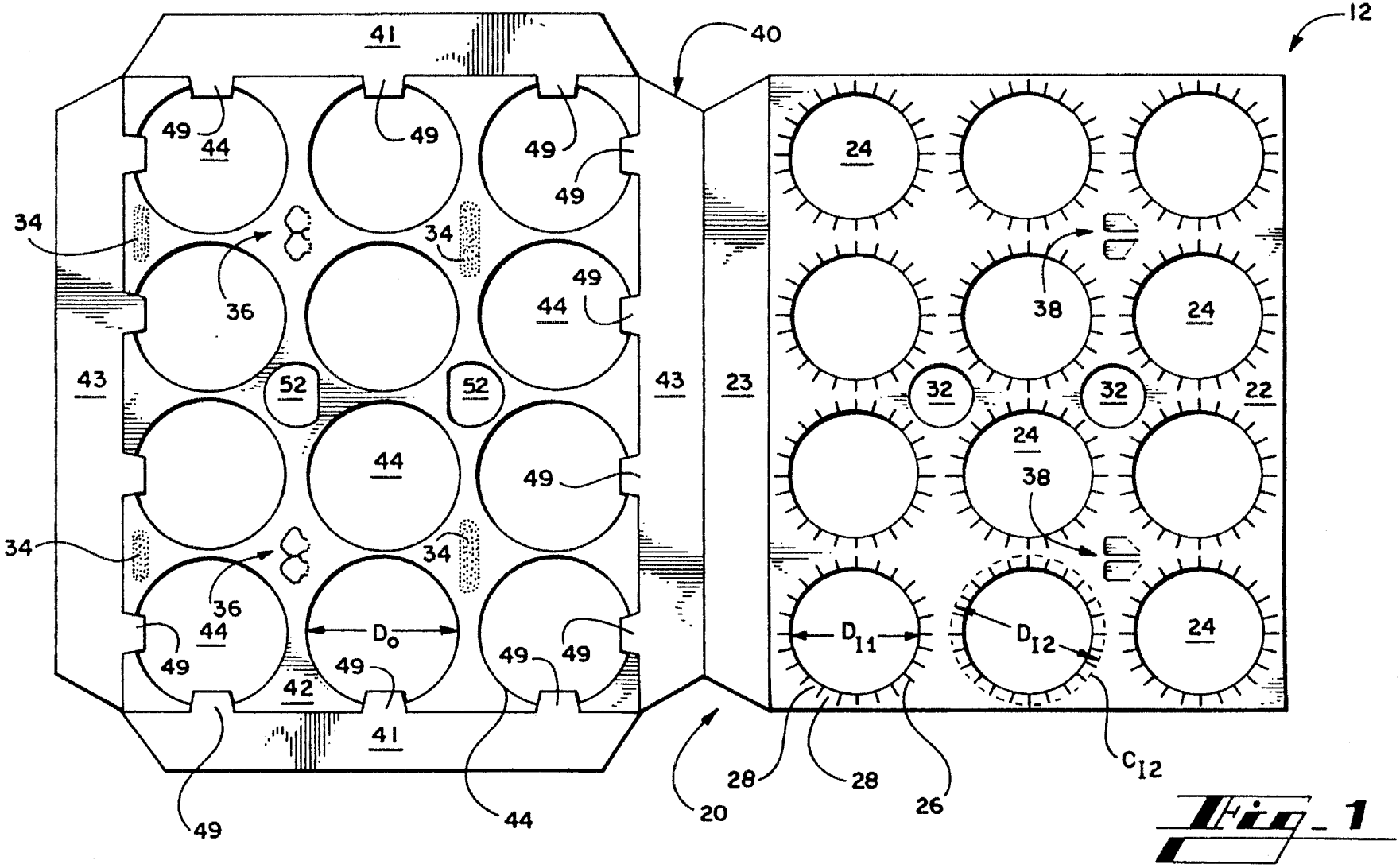
FIG. 1 is a plan view of a blank for a clip-type carrier in accordance with a preferred embodiment of the present invention.
Figure 2:
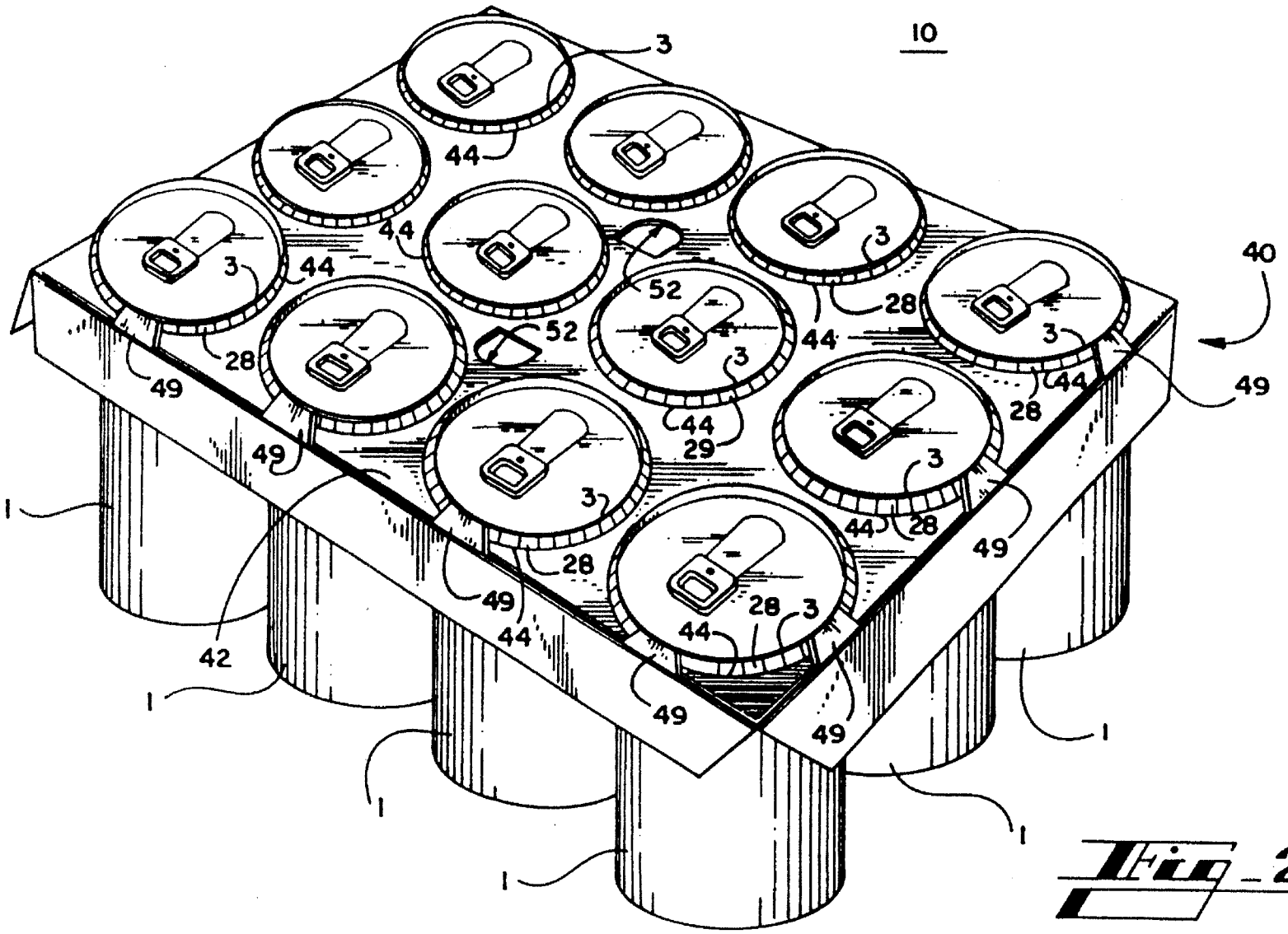
FIG. 2 is an isometric illustration of the clip-type carrier formable from the blank of FIG. 1.
Figure 3:
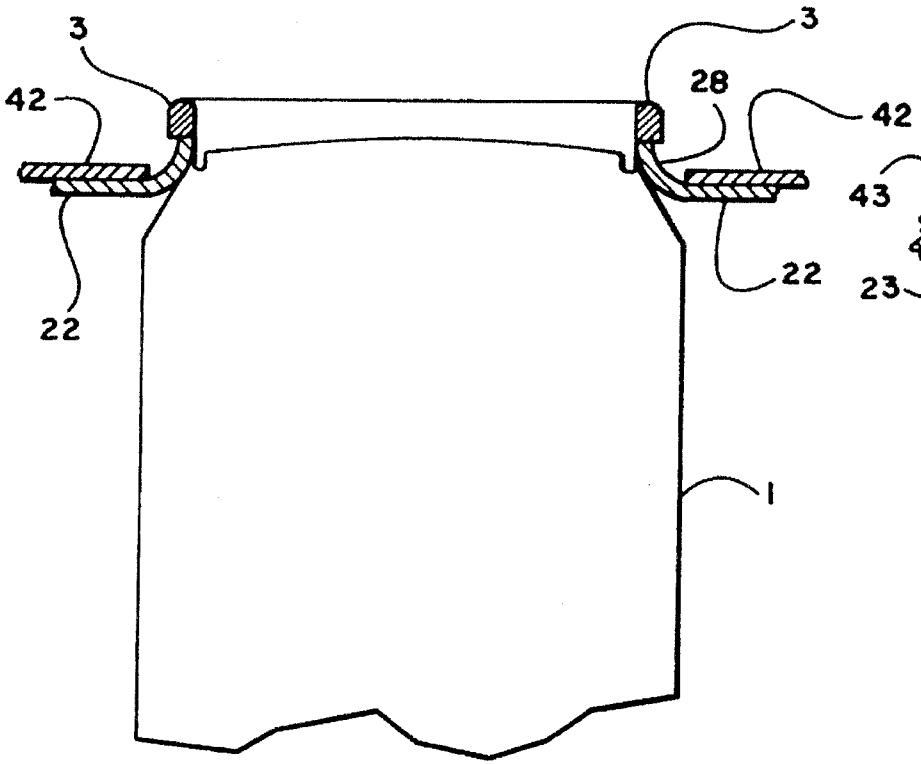
FIG. 3 is a partial sectional illustration of the carrier of FIG. 2 in engagement with a can 1.

For a general overview, reference is first made to Figs. 1, 2 and 3 simultaneously. In FIG. 2 an overlapped, erected clip-type carrier 10 according to a preferred embodiment of the invention is shown engaging several cans 1 about their respective chimes 3. FIG. 1 is a blank 10 suitable for forming the carrier of FIG. 2. FIG. 3 is cross-sectional illustration of the elements of the carrier 10 engaging a can 1 about its chime 3. The features of the invention will now be described in greater detail with reference first to the plan illustration of the blank 12 of FIG. 1. The blank 12 has an inner panel 20 and an outer panel 40. When the carrier 12 is in the erected engagement form illustrated by FIG. 2 the outer panel 40 overlaps the inner panel 20 generally throughout their respective lap portions 42, 22. An inner panel border 23 adjoins the inner lap portion 22 of the inner panel 20. The lap portion 22 of the lower panel has apertures 24 for receiving flanged articles, such as cans or bottles. For convenience, these apertures 24 are generally referred to herein as inner article-receiving apertures or inner apertures 24. The inner apertures have radial slits 26 extending from the circumference of the inner aperture 24 that create tabs 28. The inner edges of the tabs 28 define an inner circumference of the inner aperture 24 which has a diameter designated $D_{I1}$ in FIG. 1. The tabs are of substantially equal length such that their inner edges which are attached to the inner panel 20 form an imaginary, or notional, circumference designated as $C_{I2}$ having a second diameter designated $D_{I2}$. The lap portion 22 of the inner panel 20 also has finger holes 32 and female lock elements 38 for receiving male lock elements 36 contained in the outer panel. In the outer panel 40 borders 41, 43 extend around the periphery of the lap portion 42 of the outer panel 40. The inner 20 and outer 40 panels are joined along a pair of respective borders 23, 43. The lap portion 42 of the outer panel 40 has apertures 44 which correspond to and are aligned for concentric alignment with the inner apertures 24 of the inner panel. For convenience, the apertures of the outer panel are referred to herein as outer article-receiving apertures or outer apertures 44. The outer apertures have a diameter designated $D_O$. Strategically placed around the periphery of the outer lap portion 42 and extending inwardly into the outer apertures 44 from the borders 41, 43 of the outer panel 40 are locking tabs 49. Adhesive material 34 and male locking members 36 are also shown on the outer lap portion 42. The outer lap 42 portion also contains finger holes 52 which correspond to and are aligned to concentrically overlie the hand holes 32 of the inner lap portion 22.

Referring now simultaneously to FIGS. 2 and 3, therein can be seen cans 1 inserted through the inner apertures 24 with the gripping tabs 28 pushed generally upwardly into a position of engagement under the underside of the can chimes 3. In the isometric illustration of FIG. 2 the carrier 10 is seen with the outer panel 40 in overlapping position with respect to the inner panel 20 (which cannot be seen in this view). The gripping tabs 28 project upwardly from the inner panel through the outer apertures 44 of the outer panel 40. The locking tabs 49 are also engaged under the underside of can chimes 3.

The carrier 10 is very simply applied to cans 1 by insertion of the cans 1 through the face-contacting inner 24 and outer 44 apertures. The gripping tabs 28 are very firmly held in place under the flange (chime 3) of the engaged article (can 1) by the constrictive action of the outer aperture 44. The constrictive pressure applied by the outer aperture 44 results from the dimensional relationship between the apertures 24, 44 and tabs 28. That is, the diameter of the outer aperture $D_O$ which surrounds the gripping tabs 28 is greater than the diameter of the inner aperture second circumference $D_{I2}$ (the notional circumference) but less than the diameter of the first inner aperture circumference $D_{I1}$ which is defined by the unattached edges of the gripping tabs 28. The constriction urges the gripping tabs 28 against the can 1 wall or neck causing the unattached edges of the gripping tabs 28 to remain engaged under the chime 3. The snug fit between the outer aperture 44 and the gripping tabs 28 also help to maintain the inner 22 and outer 42 lap portions in flat face-to-face contact.

Figure 4:
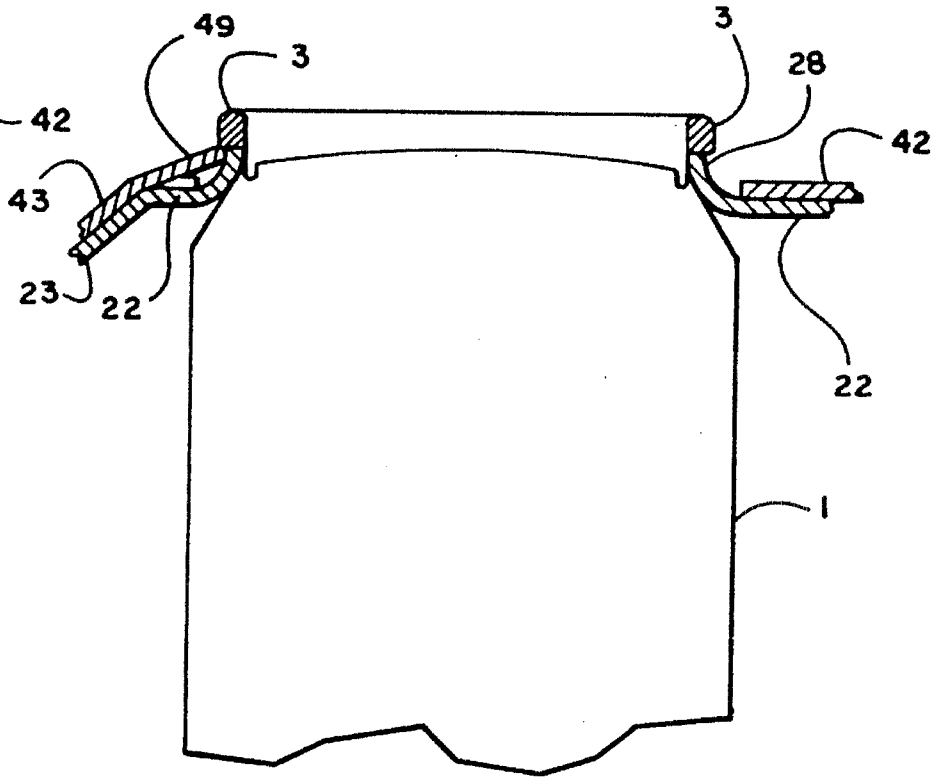
FIG. 4 is a partial sectional illustration like FIG. 3 except that a can around the periphery of the carrier is illustrated and the can is also engaged by a locking tab of the carrier.

The carrier 10 employs additional optional features that help keep the lap portions 24, 44 in contact with one another. One such feature is the locking tabs 49 which can be seen in operation in FIGS. 2 and 4. FIG. 4 in particular shows the manner in which a locking tab 49 overlies the gripping tabs 28 to also engage the underside of a can chime 3. Once so engaged, the locking tab 49 helps retain the outer lap portion 42 in place under the chimes 3 and, thus, in face-to-face contact with the inner lap portion 22.

Referring now again particularly to FIG. 1, other means for maintaining the lap portions 22, 42 together include adhesive 34 applied between the lap portions 22, 42 and a locking mechanism integrally formed with the lap portions. The integral locking mechanism illustrated contains a male portion 36 and cooperating female portion 38. An example of a suitable locking mechanism of this type is shown in U.S. Pat. No. 5,131,588, herein incorporated by reference.

Figure 5:
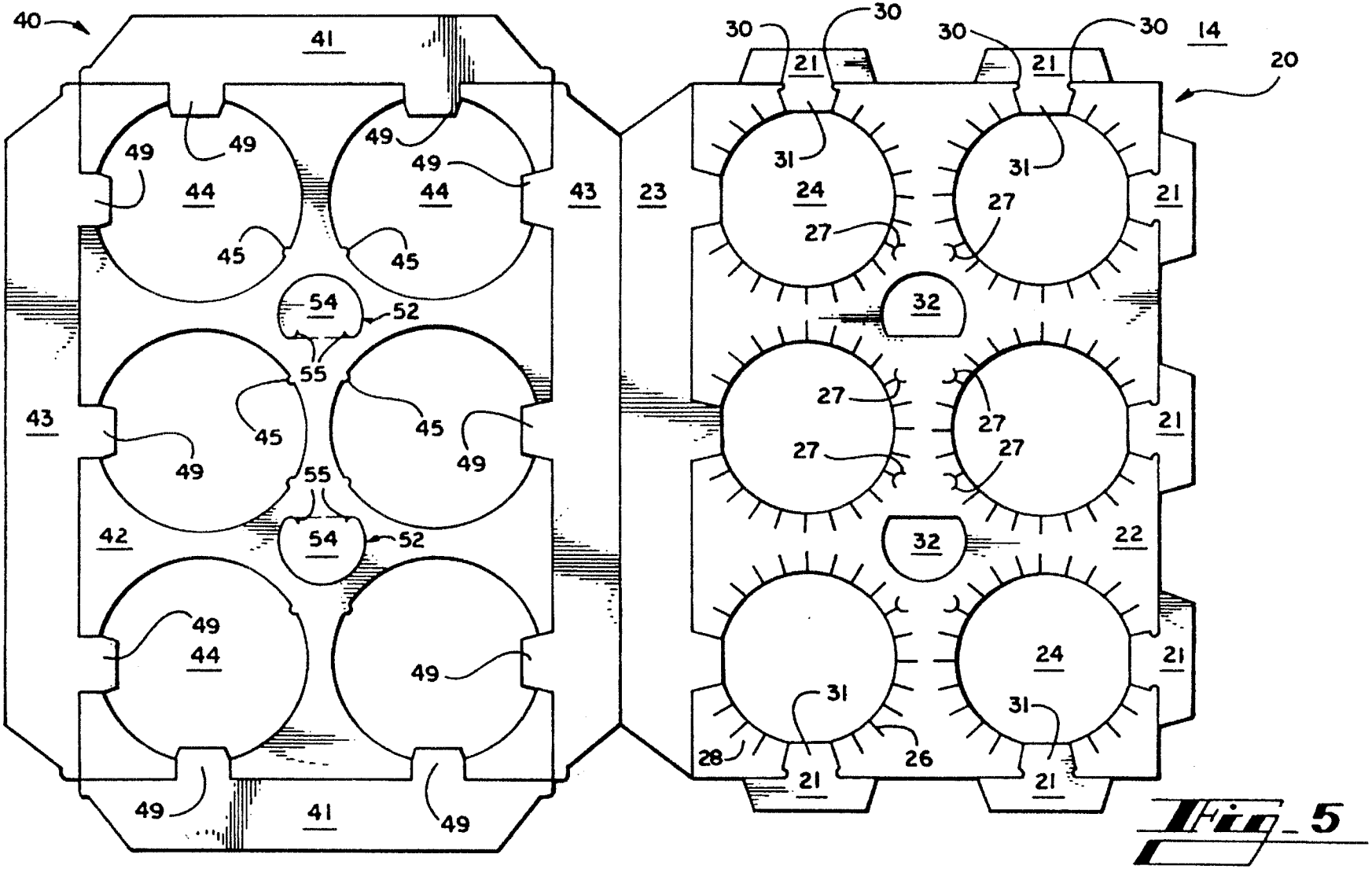
FIG. 5 is a plan view of an alternate blank for a clip-type carrier in accordance with a preferred embodiment of the present invention.
Figure 7:
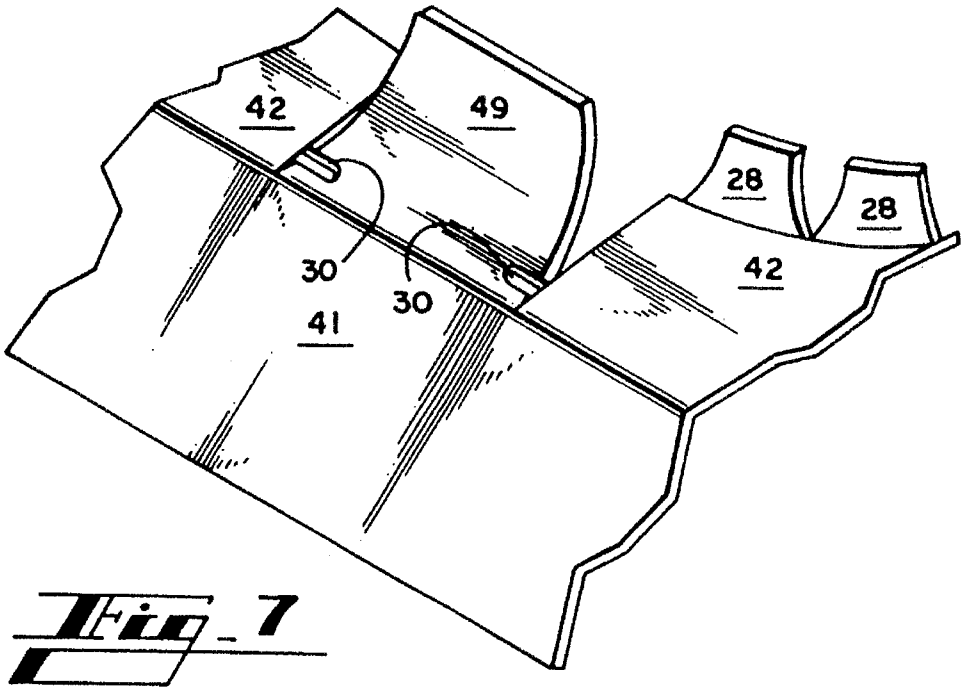
FIG. 7 is a partial isometric illustration of a locking mechanism employing locking lip members in a clip-type carrier formed from the blank of FIG. 5 in accordance with another preferred embodiment of the invention.
Figure 6:
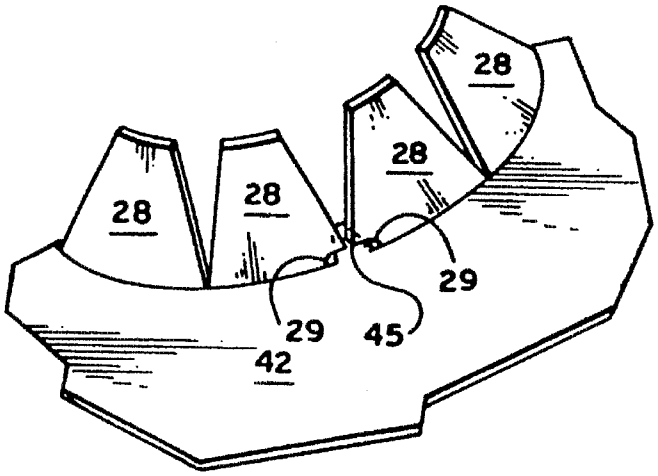
FIG. 6 is a partial isometric illustration of the aperture locking feature of the blank of FIG. 5.

Referring now to FIG. 5, in an alternate configuration of a blank 14 for a clip-type carrier according to a preferred embodiment of the invention, like the carrier 10 of FIG. 2, several additional features for locking the inner 22 and outer 42 lap portions together are illustrated. The alternate blank 14 has the same basic features as the blank 12 of FIG. 1. Identical features bear the same reference numerals. In addition to the features contained in the blank 12 of FIG. 1, the blank 14 of FIG. 5 illustrates an aperture lock structure. In the aperture lock structure at least one of the radial slits 26 terminates in an arcuate slit 27. Referring now also to FIG. 6, a securing tab 45 projects into the outer aperture 44 of the outer panel in alignment for engaging the arcuate notches 29 in the gripping tabs 28 defined by the arcuate slit 27. When the inner 22 and outer 42 lap portions are placed together and receive cans, the securing tab 45 engages the gripping tabs 28 through the arcuate notches 29 created by the arcuate slit 27. Referring now to FIGS. 5 and 7 simultaneously, therein is illustrated the use of locking lip members 30, formed by the cut-out of the auxiliary locking tab 31, to retain the locking tab 49 in place and thereby maintain the outer 42 and inner 22 lap portions in contact. Referring again particularly to FIG. 5 therein is also illustrated a finger hole flap 54 which when folded under the outer panel 40 and through the finger hole 32 of the inner panel utilizes finger hole retaining tabs 55 to maintain the finger hole flap 54 in place folded under. This serves as an additional means of maintaining the outer 42 and inner 42 lap portions in contact with one another.

Figure 8:
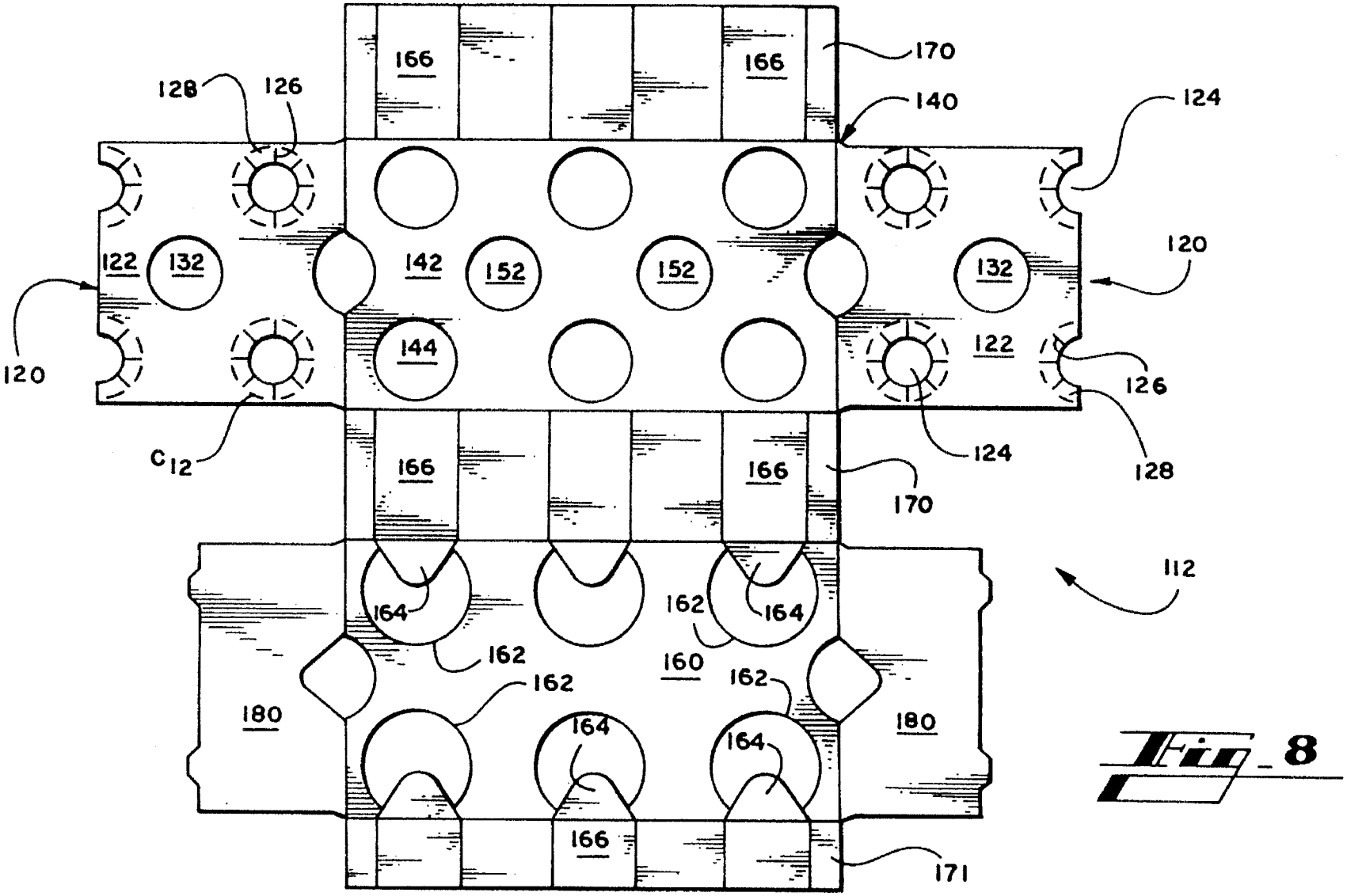
FIG. 8 is a plan view of another alternate blank for a clip-type carrier in accordance with another preferred embodiment of the present invention, and more particularly suitable for engaging bottles.

Referring now to FIG. 8, therein is shown a blank 112 for forming a clip-type carrier particularly suitable for engaging bottles in accordance with a preferred embodiment of the invention. The carrier blank 112 has many of the features as the carrier 10 and blanks 12, 14 described above. However, as those carriers were described in the context of use with cans 1, the immediate blank 112 is described in the context of being particularly useful for bottles. Many of the same features are employed as are present in the blanks described above. For convenience a "100" series of numerals is used to describe the features of the immediate blank 112 and like features bear the same numerals except as a 100 series number. Since these features function in the same manner the above description is incorporated by reference and only the differing features will be described. The blank 112 forms a generally box-like, sleeve carrier suitable for receiving elongated, flanged necks of bottles. Additional features in the immediate blank 112 include a bottom panel 160, intermediate panels 170, an auxiliary intermediate panel 171 and set-up panels 180. The blank 112 also includes pull tabs 164 and tear strips 166.

In use, the inner panels 120 are folded under and adhered to the outer panel 140 to form a composite top wall. The blank is formed into a box-like carrier by folding the composite top wall, bottom panel 160, intermediate 170, auxiliary intermediate 171 and set-up panels 180 into place and adhering the auxiliary intermediate panel to the unattached edge of the endmost intermediate panel 170. The necks of bottles are inserted into the erected carrier through the bottom apertures 162 and further upwardly through the concentrically aligned inner 124 and outer 144 apertures so that the flanges of bottles are thereby engaged by the gripping tabs 128. In the erected and loaded carrier the pull tabs 164 are used to begin tearing of the tear strips 166 to remove selected bottles which have been engaged by the carrier.

Other modifications may be made in the foregoing without departing from the scope and spirit of the claimed invention.

What is claimed is:

1. A clip-type carrier for at least one flanged article comprising:

a composite top wall including an inner panel disposed over an outer panel having at least a portion of each of said inner and outer panels that overlap to define a lap portion for each of said panels;

said inner panel having at least one inner article-receiving aperture within said lap portion thereof, said at least one inner article-receiving aperture defining an inner aperture diameter, and defining an inner aperture edge having formed therein a plurality of cuts extending radially outwardly from said inner aperture edge terminating to define a second diameter which is greater than said inner aperture diameter defining a plurality of container gripping tabs; and said outer panel having at least one outer article-receiving aperture within said lap portion thereof corresponding to and concentrically aligned with said at least one inner article-receiving aperture and defining an outer aperture diameter that is greater than said inner aperture diameter and less than said second diameter, at least one said at least one outer article-receiving aperture having at least one locking tab extending thereinto.

2. A carrier as defined in claim 1, wherein said at least one of said at least one outer article-receiving aperture is adjacent a periphery of said outer panel.

3. A carrier as defined in claim 2, wherein said securing means further includes said inner panel having at least one pair of lip members adjacent a periphery of said inner panel for engaging said at least one of said at least one locking tab.

4. A carrier as defined in claim 3, wherein each said pair of lip members is formed from a cut-out defined by an auxiliary locking tab extending to said inner aperture edge of said at least one inner article-receiving aperture.

5. A carrier as defined in claim 1, wherein said securing means further comprises said inner panel having at least one auxiliary locking tab extending to said inner aperture edge of said at least one inner article-receiving aperture in alignment with said at least one locking tab.

6. A clip-type carrier for at least one flanged article comprising:

a composite top wall including an inner panel disposed over an outer panel having at least a portion of each of said inner and outer panels that overlap to define a lap portion for each of said panels;

said inner panel defining at least one inner article-receiving aperture within said lap portion thereof, said at least one inner article-receiving aperture defining an inner aperture diameter, and defining an inner aperture edge having formed therein a plurality of cuts extending radially outwardly from said inner aperture edge terminating to define a second diameter which is greater than said inner aperture diameter defining a plurality of container gripping tabs; and said outer panel having at least one outer article-receiving aperture within said lap portion thereof corresponding to and concentrically aligned with said at least one inner article-receiving aperture and defining an outer aperture diameter that is greater than said inner aperture diameter and less than said second diameter, at least one said at least one outer article-receiving aperture having at least one locking tab extending thereinto and said inner panel having at least one slit in transverse intersection with one of said plurality of cuts between adjoining ones of said plurality of container gripping tabs for receiving said at least one securing tab.

7. A carrier as defined in claim 6 wherein said at least one securing tab and said at least one slit are arcuate.

* * * * *